US006210535B1

(12) United States Patent
Huovila et al.

(10) Patent No.: US 6,210,535 B1
(45) Date of Patent: Apr. 3, 2001

(54) STOCK FEED SYSTEM FOR A MULTI-LAYER HEADBOX AND METHOD IN THE OPERATION OF A MULTI-LAYER HEADBOX

(75) Inventors: Jyrki Huovila; Ari Linsuri, both of Muurame (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 08/457,328

(22) Filed: Jun. 1, 1995

(51) Int. Cl.[7] ..... D21F 1/04
(52) U.S. Cl. ..... 162/322; 162/336; 162/343
(58) Field of Search ..... 162/343, 336, 162/380, 216, 125, 127, 322

(56) References Cited

U.S. PATENT DOCUMENTS

| | | | | |
|---|---|---|---|---|
| 2,077,017 | * | 4/1937 | Schacht | 162/125 |
| 2,315,892 | | 4/1943 | Booth | 92/21 |
| 3,266,974 | | 8/1966 | Staver, Jr. | 162/343 |
| 3,598,696 | * | 8/1971 | Beck | 162/343 |
| 3,833,465 | | 9/1974 | Campbell | 162/129 |
| 4,021,295 | * | 5/1977 | Schmaeng | 162/343 |
| 4,086,130 | * | 4/1978 | Justus | 162/343 |
| 4,384,922 | * | 5/1983 | Stotz | 162/343 |
| 4,445,974 | | 5/1984 | Stenberg | 162/300 |
| 4,744,866 | | 5/1988 | Koponen et al. | 162/203 |
| 4,781,793 | | 11/1988 | Halme | 162/55 |
| 4,889,594 | | 12/1989 | Gavelin | 162/130 |
| 5,074,965 | | 12/1991 | Keskiivari et al. | 162/216 |
| 5,401,363 | * | 3/1995 | Begemann et al. | 162/343 |
| 5,405,501 | | 4/1995 | Phan et al. | 162/127 |
| 5,466,340 | | 11/1995 | Begemann et al. | 162/216 |

FOREIGN PATENT DOCUMENTS

| | | | |
|---|---|---|---|
| 3720618 | 1/1988 | (DE) . | |
| 4125513 | 2/1993 | (DE) | D21B/1/34 |
| 0629739 | 12/1994 | (EP) | D21F/1/02 |
| 0651092 | 5/1995 | (EP) | D21F/9/00 |

* cited by examiner

*Primary Examiner*—Richard Crispino
(74) *Attorney, Agent, or Firm*—Steinberg & Raskin, P.C.

(57) ABSTRACT

A stock feed system for a multi-layer headbox and a method in the operation of a multi-layer headbox in which into each inlet header of the multi-layer headbox, a stock concept is passed which has been produced out of the same fresh stock by adding the necessary chemicals and fillers to separated portions of the fresh stock. Into the stock feed system of the multi-layer headbox, at least one dilution-water line is passed.

18 Claims, 5 Drawing Sheets

10
14
14a1.1
14a1.2
11 M1
12 M2
13 M3
15
15a1.1
15a1.2
16
17
M
18a
P1
18a2
18a2.1
18a2.2
18a3
19a1
19a2
3a
3b
C
5a
5b
5c
5aa
5bb
5cc
E1
E2
E3
20a1
20a2
20a3
100a1
100a2
100a3
21a1
21a2
21a3
M1
M2
M3

STOCK FEED SYSTEM FOR A MULTI-LAYER HEADBOX AND METHOD IN THE OPERATION OF A MULTI-LAYER HEADBOX

This application is related to U.S. patent application Ser. No. 08/323,839 filed Oct. 17, 1994, the specification of which is hereby incorporated by reference herein.

BACKGROUND OF THE INVENTION

The present invention relates to a stock feed system for a multi-layer headbox and a method in the operation of a multi-layer headbox.

In the prior art, systems for the operation of multi-layer headboxes are known in which there are separate fresh stocks for the surface layers of a pulp flow discharged from the headbox and for the middle layers thereof. Thus, in the prior art systems, there have been at least double fresh-stock systems for the formation of the different pulp layers. In the prior art equipment, the stocks introduced along at least two separate fresh-stock lines have been processed in vortex cleaning and in deaeration tanks, and feeds of fillers or starch complying with the required paper grade have been passed into the at least two fresh-stock lines.

With the prior art technology, a paper machine into whose headbox stock is fed at different consistencies requires a complete short circulation which comprises more than one stock systems. This is also the case when the stock in the different layers is in the other respects the same, but the consistencies are different.

Increased consistency of layers may be necessary, for example, in order that an improved purity of the layers can be achieved. When the middle layer is thicker than the surface layers, water of the middle layer is drained through the surface layers to a relatively limited extent. In such a case, particles of the middle layer are not carried along with the water into the surface layer, and the purity of the layers remains good.

A very thick middle layer is highly flocculated, in which case it has a high bulk. Then, the structure of the paper results in a bulky paper of good bending stiffness, in which the formation of the middle layer is poor but the formation of the surface layers is good, which secures good printing properties.

OBJECTS AND SUMMARY OF THE INVENTION

It is an object of the present invention to provide a new and improved stock feed system for a multi-layer headbox and a method in the operation of a multi-layer headbox in which each layer of a multi-layer pulp web discharged from the headbox can be diluted separately and/or simultaneously, in which case, e.g., the stocks passed into the inlet headers of a multi-layer headbox can be given the desired consistencies.

In order to achieve the object stated above, and others, in the present invention, the stock for one or several layers in the feed pipe systems for the inlet headers of the headbox are diluted. The diluting can take place before screens in the feed path through the feed pipe system if each layer has a screen of its own, or after the stock has been divided to be fed into the different layers.

In the present invention, in a paper machine that comprises a multi-layer headbox and therein at least two separate inlet headers or equivalent, for the inlet headers, separate stocks are prepared out of the same fresh stock, and they are passed into the inlet headers from the same stock tank. According to the invention, the fresh stock passed out of the stock tank is divided into two or more component flows. Into these component flows to be fed into the multi-layer headbox, chemicals and/or additives purposeful for the quality or the economy of production of different paper grades are passed.

Further, according to the invention, the system also includes dilution-water lines passing to the stock system of the headbox. Preferably, the dilution lines are arranged to pass from a dilution-water header through valves and to join the stock line connected with the inlet header for each stock layer. Thus, according to the invention, in the stock feed system, each layer can be diluted separately and/or simultaneously, in which case, e.g., the stocks passed into the inlet headers of a multi-layer headbox can be given the desired consistencies. When certain additives are added to the stock flow, it may be the case that the stock has a low dry solids content before mixing of the additive. Thus, before the additive is passed into the stock, the stock may be diluted to the desired dry solids content to add the additive concerned into the fresh stock in an optimal manner.

In the stock system in accordance with the present invention for a multi-layer headbox, into each inlet header of the multi-layer headbox, a stock concept is passed which has been produced out of the same fresh stock by adding the necessary chemicals and fillers to the fresh stock. The stock feed system in accordance with the present invention for a multi-layer headbox thus comprises at least one dilution-water line.

In the method in accordance with the invention, the stock for each inlet header is prepared out of a single fresh stock by adding the necessary chemicals and fillers to the fresh stock. Dilution water is passed into at least one stock line that passes into an inlet header of the multi-layer headbox. Thus, in one embodiment, the method is used in the operation of a multi-layer headbox having at least two inlet headers into which a respective stock concept is passed, the stock flowing from the inlet headers through a system of distributor pipes into a turbulence generator and further into a slice cone. A single flow of fresh stock is provided and then divided into a plurality of stock flows. Chemicals and/or fillers are independently added to each of the stock flows. Each of the stock flows is then passed after the chemicals and/or fillers have been added thereto into a respective one of the inlet headers, and a diluting-water flow is passed into at least one of the stock flows. Preferably, the diluting-water flow is passed into individual ones of the stock flows which form outer layers of a web discharged from the headbox.

The invention will be described in the following with reference to some preferred embodiments of the invention illustrated in the figures in the accompanying drawings. However, the invention is not confined to the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
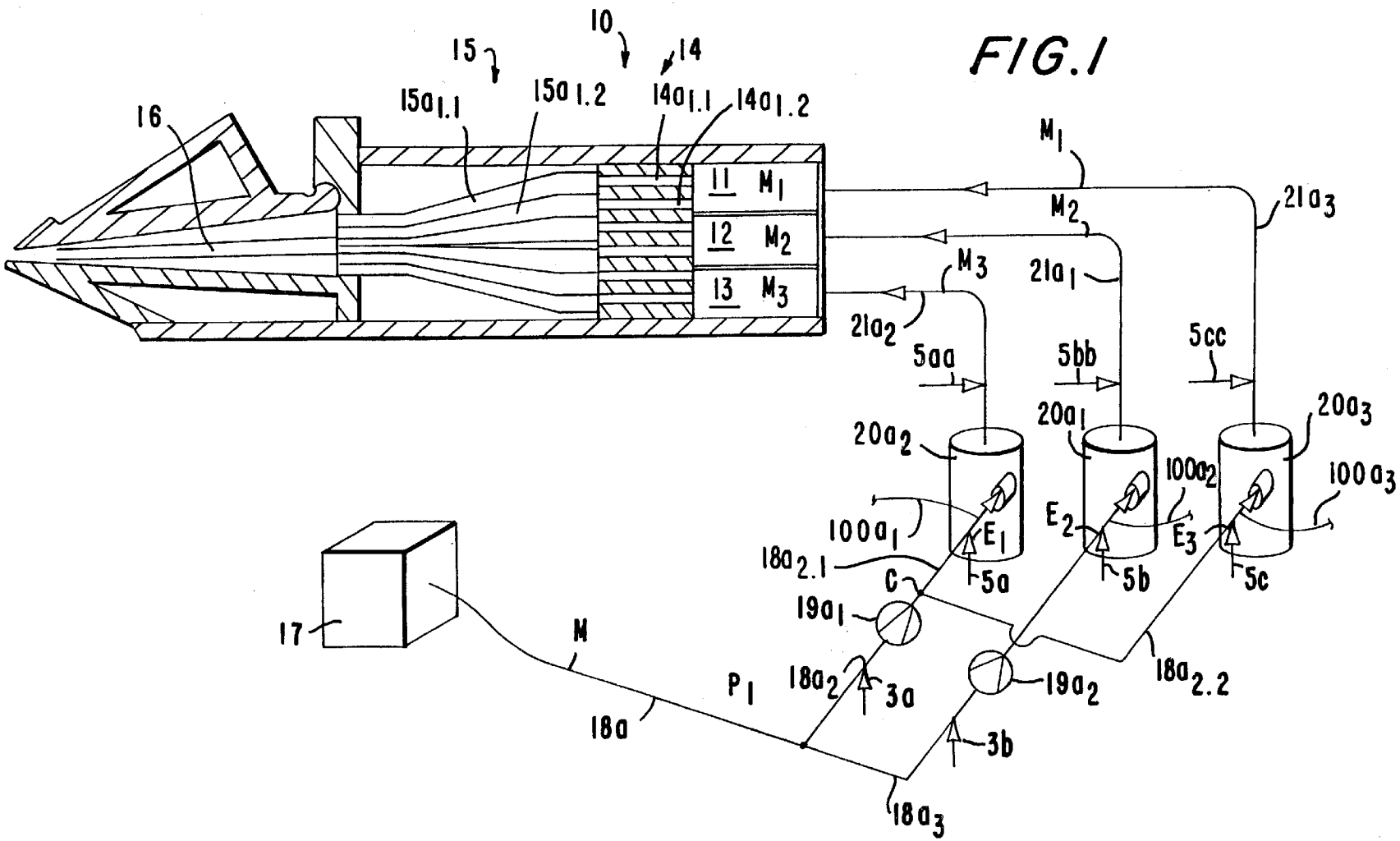
FIG. 1 shows an embodiment of the invention in which the stock flow passed out of the fresh-stock tank is divided into three component flows which are passed further, after feeds of chemicals and fillers, into the different inlet headers in the multi-layer headbox, and in which system a dilution-water line is connected with each line passing into an inlet header.

Referring to the accompanying drawings wherein like reference numerals refer to the same or similar elements, FIG. 1 is a schematic illustration of a first preferred embodiment of the invention, which is favorably suitable for the production of SC-paper. As shown in the figure, a multi-layer headbox denoted generally by reference numeral 10 comprises three inlet headers, i.e., the inlet headers 11,12 and 13. From the inlet header 11, a stock $M_1$ is passed through a distribution manifold having distribution pipes 14$a_{1.1}$, 14$a_{1.2}$, . . . to a turbulence generator 15 into turbulence tubes 15$a_{1.1}$,15$a_{1.2}$, . . . therein and further from the turbulence tubes to a slice cone 16. From the inlet header 12, a stock $M_2$ is passed through respective distribution pipes 14$a_{2.1}$,14$a_{2.2}$, . . . of the distributor manifold 14 to the turbulence generator 15 into respective turbulence tubes 15$a_{2.1}$,15$a_{2.2}$, . . . further into the slice cone 16. Similarly, from the inlet header 13, a stock $M_3$ is passed through distribution pipes 14$a_{3.1}$,14$a_{3.2}$, . . . of the distributor manifold 14 to the turbulence generator 15 into respective turbulence tubes 15$a_{3.1}$,15$a_{3.2}$, . . . and further into the slice cone 16. Thus, by means of the multi-layer headbox shown in FIG. 1, a paper web is formed out of three stocks or stock concepts $M_1$,$M_2$ and $M_3$.

In the present invention, the system comprises a single stock system, the stocks $M_1$,$M_2$ and $M_3$ being formed out of the same fresh stock M which is passed out of a single fresh-stock tank 17. As shown in FIG. 1, the fresh stock M is passed out of the fresh-stock tank 17 along a flow line 18*a* and branched at a branching point P1 into two branch lines 18$a_2$ and 18$a_3$. In the embodiment of FIG. 1, in the branch line 18$a_2$, a chemical solution 3*a* is added to the stock M, and in the branch line 18$a_3$, a chemical solution 3*b* is added. The chemical solutions may be a filler or starch. In the lines 18$a_2$,18$a_3$, the stocks are made to flow further by means of pumps 19$a_1$ and 19$a_2$ so that, along the line 18$a_3$, the stock is passed into a machine screen 20$a_1$. A retention agent 5*b* is fed into the stock before the machine screen 20$a_1$, and a retention agent 5*bb* is fed into the stock after the machine screen in a flow line 21$a_1$ therefrom. In this manner, a good mixing of the retention agent and the stock is achieved. Along the line 21$a_1$, the stock $M_2$ that was formed is passed into the middle inlet header 12 of the multi-layer headbox.

From the line 18$a_2$ after the pump 19$a_1$, from a branch point C, a line 18$a_{2.1}$ passes to a machine screen 20$a_2$, and from the machine screen 20$a_2$, the line 21$a_2$ passes to the multi-layer headbox. At the front side of the machine screen 20$a_2$, a retention agent 5*a* is fed into the line 18$a_{2.1}$, and after the machine screen 20$a_2$, a retention agent 5*aa* is fed into a line 21$a_2$ therefrom. Along the line 21$a_2$, the stock flow $M_3$ is passed into the inlet header 13 of the multi-layer headbox.

Also from the branch point C, a line 18$a_{2.2}$ passes to a machine screen 20$a_3$ and further into the multi-layer headbox. Into the line 18$a_{2.2}$, before the machine screen 20$a_3$, a retention agent 5*c* is fed, and after the machine screen 20$a_3$, a retention agent 5*cc* is fed into a flow line 21$a_3$ therefrom. Along the line 21$a_3$, the stock flow $M_1$ is passed into the inlet header 11 of the multi-layer headbox.

Thus, in view ofthe above-described construction, the stock will comprise three layers composed of different stock concepts. In FIG. 1, reference arrows 100$a_1$,100$a_2$,100$a_3$ represent the feed ducts for dilution water and is a preferred embodiment of the invention wherein the dilution water is passed to the front side of the screens 20$a_1$,20$a_2$,20$a_3$, seen in the flow direction of the stock flow, after feed points $E_1$,$E_2$,$E_3$ of the retention agents 5*a,* 5*b,* 5*c,* respectively. The invention is, however, not restricted to these favorable location of the point of introduction of the dilution-water alone. According to the invention, the desired consistency of the stock flow can be obtained by adding the desired amount of dilution water to each layer. For example, the purity of the layers can be promoted so that the uppermost web layers and the bottommost web layers in relation to the middle layer of the web are kept more dilute, in which case, less water is drained from the middle layer through the surface layers and, thus, the surface layers remain therefore pure. In such a case, out of the middle layer, particles are not removed along with drainage to the same extent as in an embodiment in which a large amount of water is also drained from the middle layer. In the present application, dilution water is understood as a substance in general that is made to flow and by whose means the consistency of the stock can be diluted. For example, clean water may be used a dilution flow or, for example, a water that has a low content of fibers.

Figure 2:
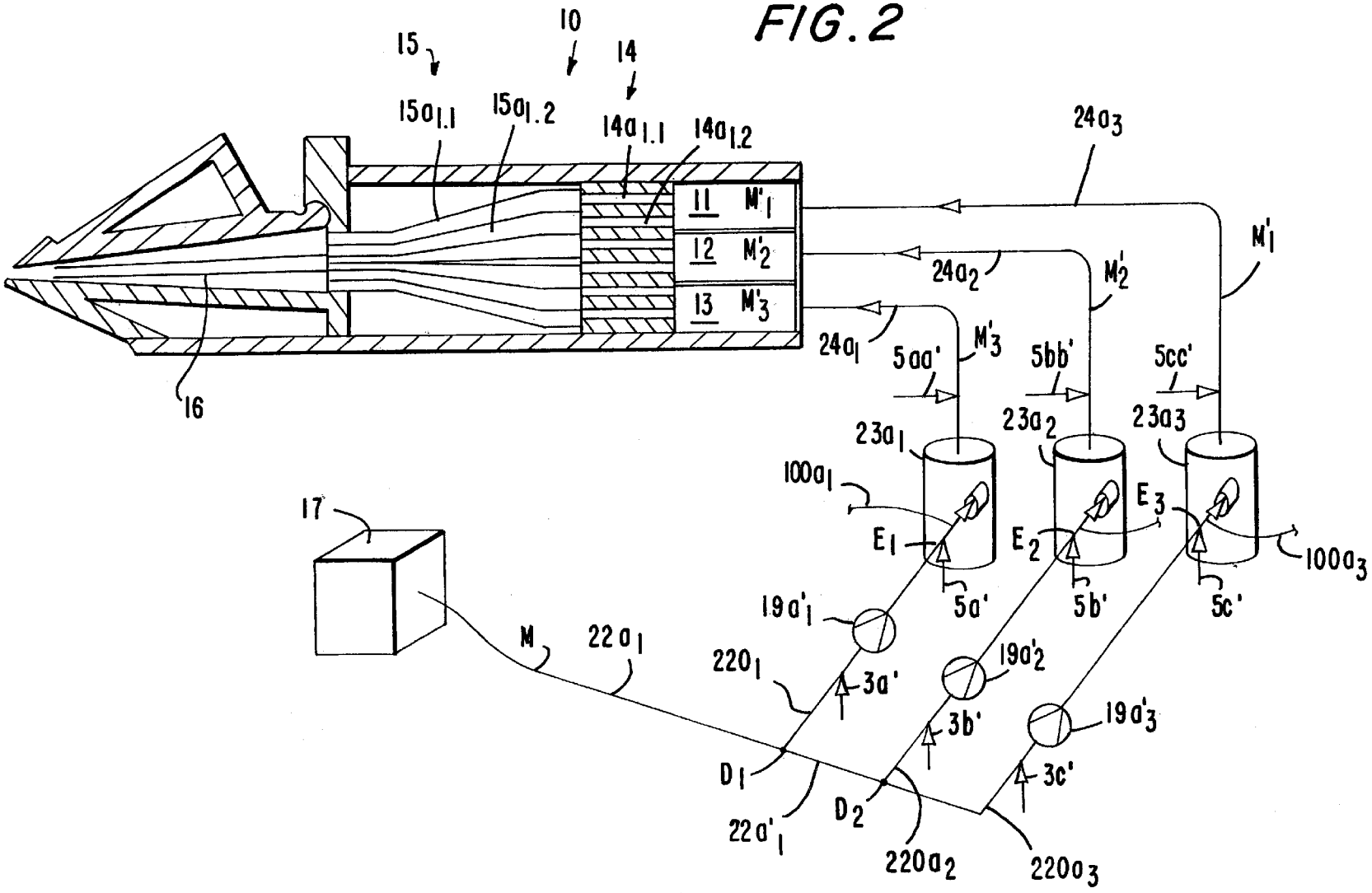
FIG. 2 shows a second embodiment related to the stock feed system in accordance with the invention for a multi-layer headbox.

FIG. 2 shows an embodiment of the invention in which one unified stock flow M is passed out of the stock tank 17 along a line 22$a_1$ to a branch point $D_1$. After the branch point $D_1$, a chemical 3*a*' is added to the fresh stock M into a line 220$a_1$ branching therefrom.

By means of the pump 19$a_1$', the stock is made to flow further into a machine screen 23$a_1$, and before the machine screen 23$a_1$, a retention agent 5*a*' is added, and after the machine screen 23$a_1$, a retention agent 5*aa*' is added to flow line 24$a_1$. The stock $M_3$' flow is passed along the line 24$a_1$ into the inlet header 13 of the multi-layer headbox.

From the branch point $D_1$, the stock M which does not flow into flow line 220$a_1$ is made to flow along a line 22$a'_1$ to a branch point D2, from which the stock M is branched into the lines 220$a_2$ and 220$a_3$. Into the line 220$a_2$, a chemical 3*b*', such as filler or starch, is added into the stock M before a pump 19$a_2$' associated with the flow line. By means of the pump 19$a_2$', the stock concept is passed further into a machine screen 23$a_2$. Before the machine screen 23$a_2$, a retention agent 5*b*', such as some suitable chemical, is added to the stock, and after the machine screen 23$a_2$, the retention agent 5*bb*' is added to the stock. The stock concept $M_2$' produced in this manner is passed further along a line 24$a_2$ into the multi-layer headbox, and more particularly into its middle inlet header 12.

Similarly, from the branch point $D_2$ the stock M is passed along the line 220$a_3$ into the machine screen 23$a_3$ after the feed of chemical 3*c*' thereto, by means of the circulation produced by a pump 19$a_3$'. Before the machine screen 23$a_3$, a retention agent 5$c$' is added, and after the machine screen 23$a_3$, a retention agent 5$cc$' is added, and the concept $M_1$' thereby produced is passed further along a line 24$a_3$ into the inlet header 11 of the multi-layer headbox 10.

Thus, in the concept in accordance with the invention, just a single circulation of stock is used, in which there is just one starting fresh stock M. The fresh stock M is processed further by to it adding chemicals and fillers, whereby out of one fresh stock M all the necessary different stock concepts $M_1$',$M_2$' and $M_3$' are obtained for the different inlet headers 11,12 and 13 of the multi-layer headbox.

In FIG. 2, an embodiment is shown in which the dilution-water lines 100$a_1$,100$a_2$,100$a_3$ are passed to the inlet side of the stock screens 23$a_1$,23$a_2$,23$a_3$, respectively, and to the outlet side of the pumps 19$a_1$',19$a_2$',19$a_3$'. The dilution water is passed to the lines 220$a_1$,220$a_2$,220$a_3$ preferably to the rear side of the feed points $E_1$,$E_2$ and $E_3$ of the retention agents 5$a$',5$b$',5$c$', seen in the flow direction. The figure shows an embodiment in which three pump devices 19$a_1$', 19$a_2$',19$a_3$' are employed. Within the scope of the invention, an embodiment is, of course, possible in which one pump device only is used, for example, in the line 22$a_1$. Thus, it is also possible to make the stock flow out of the tank 17 by means of one pump into the stock lines 220$a_1$,220$a_2$ and 220$a_3$.

Figure 3:
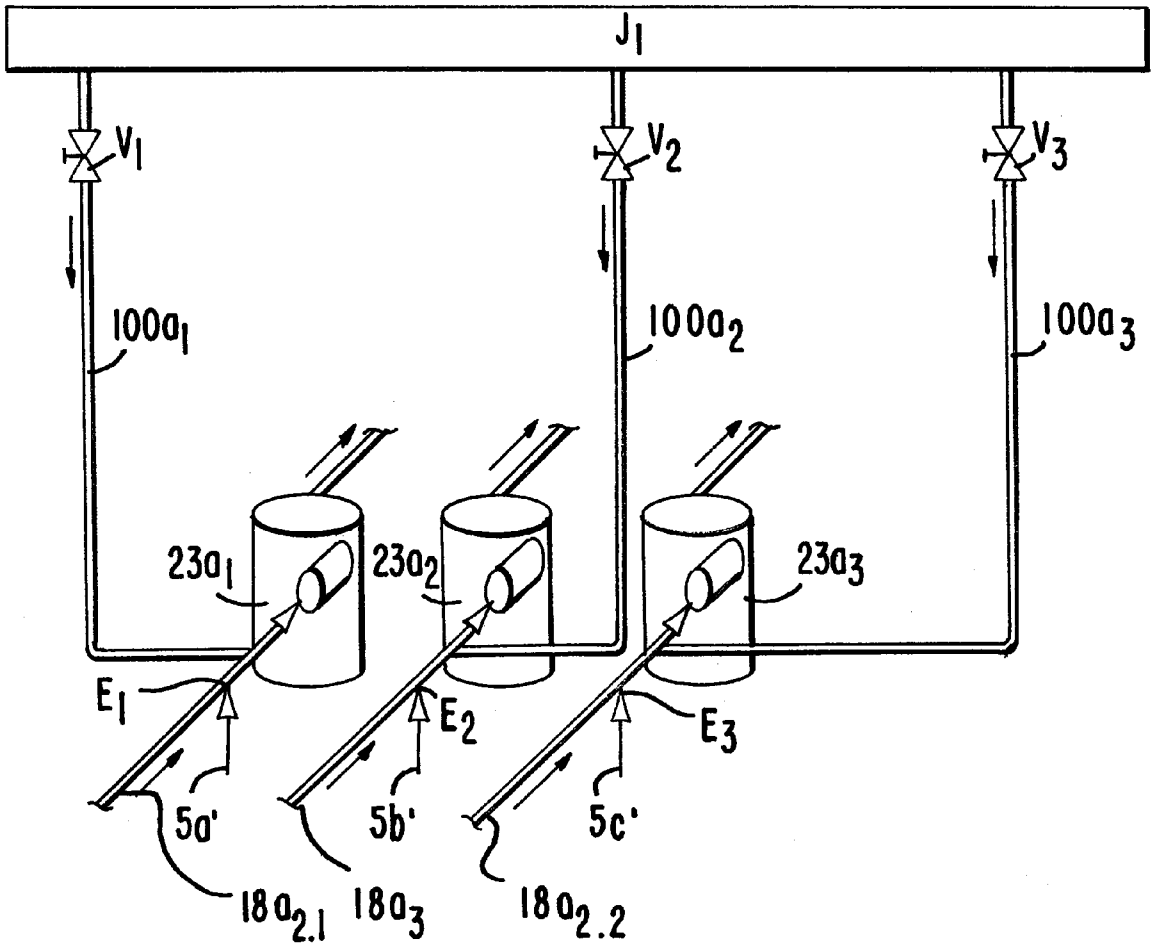
FIG. 3 shows the arrangement of introduction of dilution water with the inlet header and the regulation valves.

FIG. 3 illustrates the passing of the dilution water out of an inlet header $J_1$ into the lines 100$a_1$,100$a_2$ and 100$a_3$. Each of the lines 100$a_1$,100$a$2 and 100$a$3 comprise a regulation valve $V_1$,$V_2$ and $V_3$, respectively, by whose means the dilution-water flow can be regulated into stock lines 18$a_{2.1}$, 18$a_3$ and 18$a_{2.2}$. In the embodiment of FIG. 3, the dilution water is introduced after the points $E_1$,$E_2$,$E_3$ of addition of retention agents 5$a$',5$b$',5$c$' to the stock line. The dilution water is introduced before machine screens 23$a_1$,23$a_2$ and 23$a_3$, so that the dilution water is mixed efficiently with the stock M, which has been passed out of the common stock tank 17 of the system. Thus, in the stock circulation system in accordance with the invention exemplified by this embodiment, the fresh stock M is passed from one common tank 17 and branched into one or several branch lines, in which the necessary fillers/additives are added and, moreover, the necessary diluting of the fresh stock is also carried out.

Figure 4A:
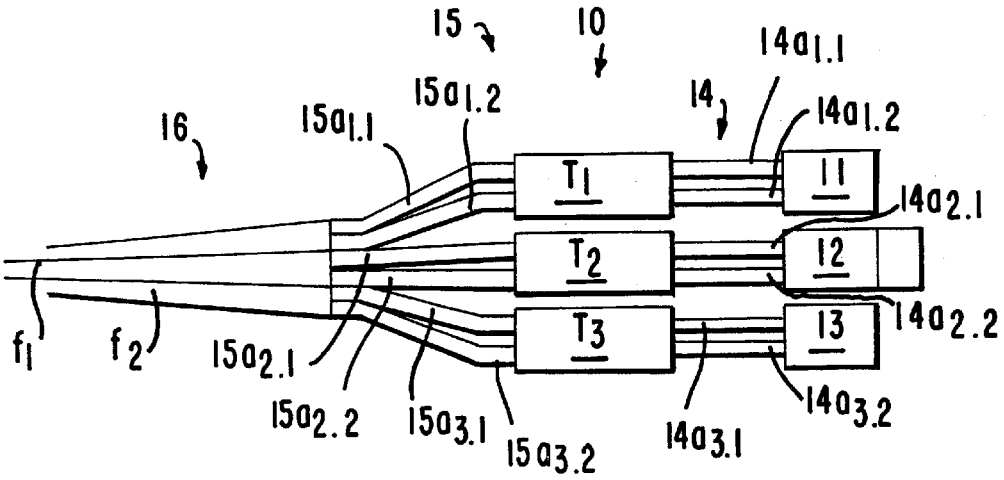
FIG. 4A is a side view of a multi-layer headbox in accordance with the invention.

FIG. 4A is a side view of a multi-layer headbox used in the system in accordance with the invention, it being understood that the system can be used in any number of headbox having similar or different constructions. In the illustrated embodiment, a fresh stock M is passed out of the same stock tank 17 through the points for addition of additives and further into the inlet header 11, 12 and 13 of each of the individual layers in the multi-layer headbox 10. As shown in FIG. 4A, the construction is in the other respects similar to those shown in the embodiments of FIGS. 1 and 2, except that, after the tube bank or distribution manifold 14 related to each of the inlet headers 11,12,13, the headbox comprises intermediate chambers $T_1$, $T_2$ and $T_3$. Thus, the fresh stock is introduced from the stock tank 17 and branched into the branch lines and passed, after possible additions of additives and dilution water, into the respective inlet headers 11,12,13. From the inlet headers, the stock concepts $M_1$,$M_2$,$M_3$ are passed into the tube bank 14, into the intermediate chambers $T_1$,$T_2$ and $T_3$, respectively, and further, through the turbulence tubes in the turbulence generator 15, into the slice cone 16. The slice cone 16 comprises aprons $f_1$,$f_2$. The aprons $f_1$,$f_2$ are arranged at least between each of the stock concepts $M_1$,$M_2$ and $M_3$ to provide separation for the same in the slice cone 16.

Figure 4B:
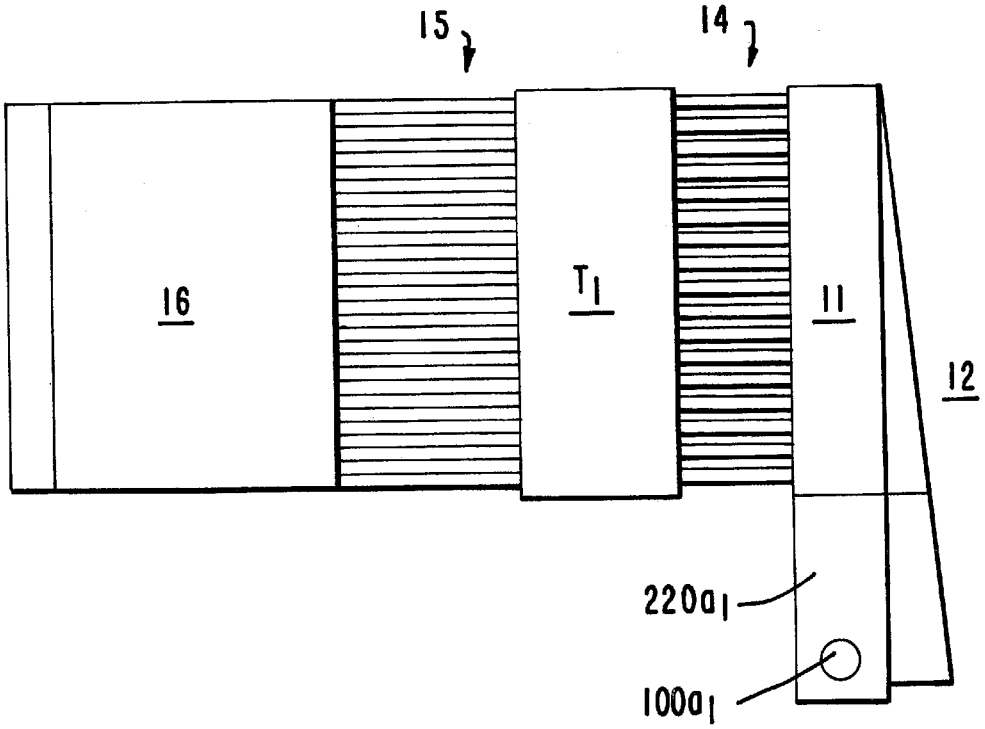
FIG. 4B is a top view of the multi-layer headbox as shown in FIG. 4A.

FIG. 4B is a top view of the system shown in FIG. 4A. In this figure, the dilution-water line 100$a_1$ for dilution water connected with the inlet header 11 is shown.

Figure 5A:
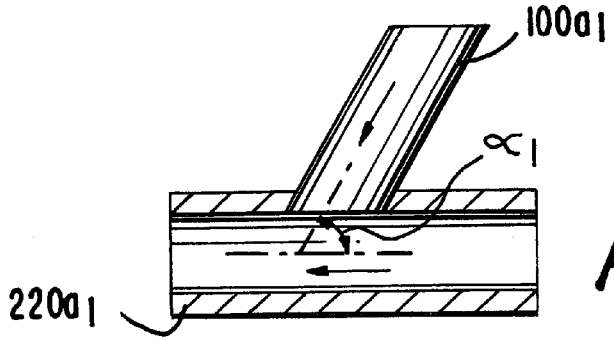
FIG. 5A shows a first preferred embodiment of the supply of dilution water into the stock.

FIG. 5A shows an embodiment of the invention in which the dilution water is passed at an acute angle $\alpha_1$ along the line 100$a_1$ into the stock flow, into the stock line 220$a_1$.

Figure 5B:
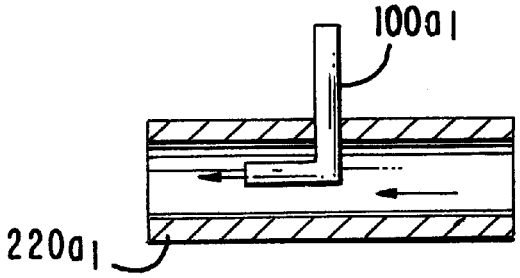
FIG. 5B shows a second preferred embodiment of the supply of dilution water.

FIG. 5B shows an embodiment of the invention in which the dilution-water line 100$a_1$ is passed centrally into the stock line 220$a_1$ through a tube portion extending into the stock flow. The dilution flow is discharged from the dilution-water line 100$a_1$ in the direction of the stock flow into the stock line 220$a_1$.

Figure 5C:
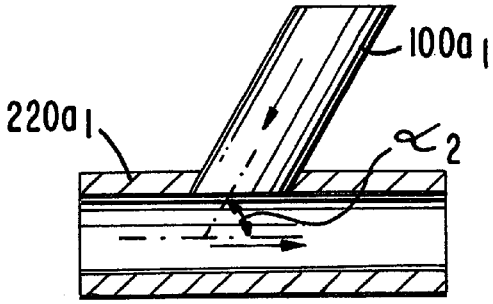
FIG. 5C shows a third preferred embodiment of the supply of dilution water.

FIG. 5C shows an embodiment of the invention in which the dilution water is passed along the line 100$a_1$ into the stock line 220$a_1$ and at an acute angle $\alpha_2$ against the stock flow.

Figure 5D:
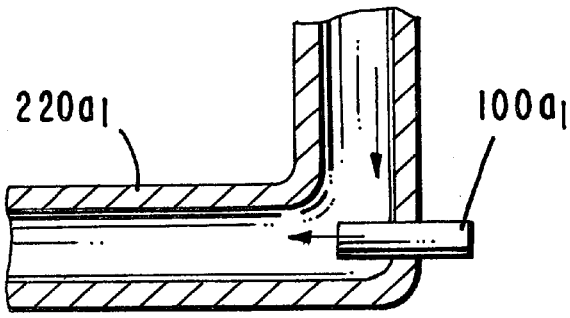
FIG. 5D shows a fourth preferred embodiment of the supply of dilution water.

FIG. 5D shows an embodiment of the invention in which the dilution water is passed along the line 100$a_1$ centrally into the stock line 220$a_1$ which has a L-shaped portion, i.e., two portions perpendicular to one another. The dilution water is passed into one of the portions of stock line 220$a_1$ in the direction of flow of the stock flow.

The examples provided above are not meant to be exclusive. Many other variations of the present invention would be obvious to those skilled in the art, and are contemplated to be within the scope of the appended claims. For example, the dilution water may be passed into each of the flow lines 18$a_{2.1}$,18$a_{2.2}$,18$a_3$ in FIG. 1 or 220$a_1$,220$a_2$,220$a_3$ in FIG. 2 in any of the ways shown in FIGS. 5A, 5B, 5C and 5D.

What is claimed is:

1. A combination of a multi-layer headbox including inlet headers situated vertically one above another and a stock feed system for feeding stock to the inlet headers of the multi-layer headbox, the stock feed system comprising a single fresh stock tank for retaining stock, a branching member, a first flow line having first and second opposed ends, said first end of said first flow line being connected to said single fresh stock tank and said second end of said first flow line being connected to said branching member, a single flow of fresh stock being passed through said first flow line from said single fresh stock tank to said branching member and being divided in said branching member into a plurality of stock flows without storing said single flow of fresh stock between said single fresh stock tank and said branching member, at least second and third flow lines each having first and second opposed ends and through each of which a respective one of said divided stock flows passes, said first ends of said second and third flow lines being connected to said branching member and said second ends of said second and third flow lines leading to a respective one of said inlet headers of said headbox, a respective one of said divided stock flows being passed through each of said second and third flow lines from said branching member without storing said divided stock flows between said branching member and said inlet headers, means for independently adding chemicals and/or fillers to each of said divided stock flows during the flow of said divided stock flows through a respective one of said at least second and third flow lines after said branching member and before entry of said divided stock flows into said inlet headers such that stock in each inlet header has an independently controllable chemical and/or filler characteristic, and diluting means for adjusting the consistency of at least one of said divided stock flows such that said at least one of said divided stock flows has a consistency independently adjustable with respect to the consistency of other of said divided stock flows, said diluting means comprising conduit means for passing a diluting-water flow into said at least one of said divided stock flows as said at least one of said divided stock flows is passing through a respective one of said at least second and third flow lines prior to entry of said at least one of said divided stock flows into the respective one of said inlet headers of said headbox.

2. The combination of claim 1, wherein said conduit means comprise a diluting-water flow line connected to the respective one of said at least second and third flow lines through which said at least one of said divided stock flows is passing and through which the diluting-water flow is passed.

3. The combination of claim 2, wherein said diluting-water flow line has an outlet end extending into a central region of the respective one of said at least second and third flow lines through which said at least one of said divided stock flows is passing, the flow out of said dilution-water flow line substantially coinciding with a flow direction of the stock in the respective one of said at least second and third flow lines through which said at least one of said divided stock flows is passing.

4. The combination of claim 1, wherein said conduit means comprise a diluting-water flow line connected to each of said at least second and third flow lines, at least one of said dilution-water flow lines being connected to a respective one of said at least second and third flow lines at an oblique angle such that the directional component of the flow out of said at least one dilution-water flow line parallel to a direction of the stock flow in the respective one of said at least second and third flow lines substantially coincides with the flow direction of the stock flow in the respective one of said at least second and third flow lines.

5. The combination of claim 1, wherein said conduit means comprise a diluting-water flow line connected to each of said at least second and third flow lines, at least one of said dilution-water flow lines being connected to a respective one of said at least second and third flow lines at an acute angle such that the directional component of the flow out of said at least one dilution-water flow line parallel to a direction of the stock flow in the respective one of said at least second and third flow lines is in a direction opposite to the flow direction of the stock flow in the respective one of said at least second and third flow lines.

6. The combination of claim 1, wherein said conduit means comprise a diluting-water flow line connected to each of said at least second and third flow lines, at least one of said at least second and third flow lines having a substantially L-shaped portion, one of said dilution-water flow lines being connected to and extending into an interior of said L-shaped portion of said at least one flow line such that the flow out of said dilution-water flow line substantially coincides with a flow direction of the stock flow in said L-shaped portion.

7. The combination of claim 1, wherein said diluting means comprise a single diluting water inlet header, said conduit means comprise dilution-water flow lines each having a first end connected to said single diluting water inlet header and a second end connected to a respective one of said at least second and third flow lines, and said dilution means further comprise regulation valves arranged in association with said dilution-water flow lines, said regulation valves regulating the flow of dilution water into said at least second and third flow lines.

8. The combination of claim 1, further comprising pumps coupled to a respective one of said at least second and third flow lines for pumping said stock flows through said at least second and third flow lines.

9. The combination of claim 8, further comprising a machine screen coupled to each of said at least second and third flow lines and arranged after said pumps in a flow direction, said means for independently adding chemicals and/or fillers to said stock flows being structured and arranged to add chemicals and/or fillers before said pumps, after said pumps and before said machine screens and after said machine screens.

10. Method for supplying stock to a multi-layer headbox having at least two inlet headers situated vertically one above another and into which stock having respective stock characteristics is passed, the stock flowing from said inlet headers through a system of tubes and further into a slice cone, comprising the steps of:

retaining stock in a single fresh stock tank, continuously passing said single flow of fresh stock from said single fresh stock tank to a branching point at which said single flow of fresh stock is divided into a plurality of stock flows without storing said single flow of fresh stock between said single fresh stock tank and said branching point, continuously passing each of said divided stock flows from said branching point into a respective one of said inlet headers without storing said divided stock flows between said branching point and said inlet headers, independently adding chemicals and/or fillers to each of said divided stock flows during the flow of said divided stock flows after said branching point and before entry of said divided stock flows into said inlet headers such that stock in each inlet header has an independently controllable chemical and/or filler characteristic, and adjusting the consistency of at least one of said plurality of divided stock flows such that said at least one of said plurality of divided stock flows has a consistency independently adjustable with respect to the consistency of other of said divided stock flows, said consistency adjusting step comprising the step of passing a diluting-water flow into said at least one of said divided stock flows prior to entry of said at least one of said divided stock flows into the respective one of said inlet headers.

11. The method of claim 10, wherein the diluting-water flow is passed into individual stock flows of said divided stock flows which form outer layers of a web discharged from the headbox.

12. The method of claim 10, wherein each of said divided stock flows is passed through a separate line after said branching point, further comprising the step of:

adding a chemical solution into each of said lines to formulate a particular stock concept to be fed into the respective inlet header of the multi-layer headbox.

13. The method of claim 12, further comprising the step of pumping said divided stock flows through said lines via pumps.

14. The method of claim 13, further comprising the steps of coupling a machine screen to each of said lines after said pumps in a flow direction, and adding said chemicals and/or fillers before said pumps, after said pumps and before said machine screens and after said machine screens.

15. The method of claim 10, further comprising the steps of dividing said single flow of fresh stock into only two separate flows, passing said two flows through branch lines, dividing said branch line of a first one of said two flows to provide stock concept for an uppermost and lowermost inlet header in the headbox, and passing a second one of said two flows into a middle inlet header arranged between the uppermost inlet header and the lowermost inlet header.

16. In a combination of a multi-layer headbox and a stock feed system for the multi-layer headbox, including a single fresh stock tank for retaining stock, means for forming a plurality of stock flows from from said single flow of fresh stock from said single fresh stock tank, a plurality of inlet headers arranged in said headbox vertically one above another, and means for continuously passing each of said plurality of stock flows into a respective one of all of said inlet headers of said headbox without storing stock between said single fresh stock tank and said inlet headers, the improvement comprising diluting means for adjusting the consistency of at least one of said plurality of stock flows such that said at least one of said plurality of stock flows has a consistency independently adjustable with respect to the consistency of other of said plurality of stock flows, said diluting means comprising conduit means for passing a diluting-water flow into said at least one of said plurality of stock flows prior to entry of said at least one of said plurality of stock flows into the respective one of said inlet headers of said headbox.

17. The combination of claim 16, further comprising means for independently adding chemicals and/or fillers to each of said plurality of stock flows, and said plurality of stock flows being passed into said headbox after said chemicals and/or fillers have been added thereto.

18. The combination of claim 17, wherein said diluting-water flow is added after said chemicals and/or fillers have been added.

* * * * *